US011014260B2

(12) United States Patent
Zinge

(10) Patent No.: US 11,014,260 B2
(45) Date of Patent: May 25, 2021

(54) HOLDER ASSEMBLY FOR A CIRCULAR SAW TOOL

(71) Applicants: Robert Bosch GmbH, Stuttgart (DE); Bosch Limited, Bangalore (IN)

(72) Inventor: Dhananjay Raghunath Zinge, Maharashtra (IN)

(73) Assignees: Robert Bosch GmbH, Stuttgart (DE); Bosch Limited, Bangalore (IN)

( * ) Notice: Subject to any disclaimer, the term of this patent is extended or adjusted under 35 U.S.C. 154(b) by 99 days.

(21) Appl. No.: 16/423,401

(22) Filed: May 28, 2019

(65) Prior Publication Data

US 2019/0366578 A1 Dec. 5, 2019

(51) Int. Cl.

| | |
|---|---|
| ***B27B 5/38*** | (2006.01) |
| ***B27B 5/32*** | (2006.01) |
| ***B24B 45/00*** | (2006.01) |
| ***B27G 19/02*** | (2006.01) |

(52) U.S. Cl.

CPC ..... *B27B 5/32* (2013.01); *B24B 45/006* (2013.01); *B27G 19/02* (2013.01); *B27B 5/38* (2013.01)

(58) Field of Classification Search

CPC ... B27B 5/32; B27B 5/38; F16D 43/24; F16D 43/211; B27G 19/02; B27G 19/04

USPC ..... 83/665, 666; 192/129 R

See application file for complete search history.

(56) References Cited

U.S. PATENT DOCUMENTS 2,239,623 A * 4/1941 Oster ..... B26D 7/2621 83/665
2,308,679 A * 1/1943 Eason ..... F16D 13/02 192/17 R
2,491,976 A * 12/1949 Hauser ..... B26D 7/2621 403/366
2,947,399 A * 8/1960 Moore ..... F16D 43/18 192/105 BA
3,067,597 A * 12/1962 Sauerbrey ..... B23Q 11/04 464/37
3,857,180 A * 12/1974 Dooley ..... F16D 43/24 30/383
4,033,038 A * 7/1977 Lunde ..... B27B 17/083 30/382
4,044,533 A * 8/1977 Wick ..... A01D 34/6812 56/11.3
4,220,064 A * 9/1980 Potter ..... B23D 19/06 403/350
4,253,556 A * 3/1981 Zindler ..... A01D 34/6812 192/103 C
4,414,875 A * 11/1983 Pearson ..... B27B 5/34 83/425.4

(Continued)

*Primary Examiner* — Kenneth E Peterson
(74) *Attorney, Agent, or Firm* — Maginot, Moore & Beck LLP

(57) ABSTRACT

A holder assembly for a circular saw tool includes a blade having a bore. The blade is mountable to a free end of a rotatable shaft or of the tool through the bore. The blade is further adapted to be held in a pressing manner between an inner flange and an outer flange on the shaft. The holder assembly is comprised of at least one depression formed on a circumferential surface of the free end of the shaft, and at least one clutch member (or dogs) paired and mounted about the at least one depression, and located between the bore of the blade and the shaft. The holder assembly provides improved gripping while safety or emergency braking.

10 Claims, 4 Drawing Sheets

(56) References Cited

U.S. PATENT DOCUMENTS

| | | | | |
|---|---|---|---|---|
| 5,293,798 | A * | 3/1994 | Otani | B27B 5/34 83/504 |
| 5,560,465 | A * | 10/1996 | Zindler | F16D 43/18 192/105 BA |
| 6,439,091 | B1 * | 8/2002 | Dibbern | B27B 5/32 30/388 |
| 7,510,062 | B2 * | 3/2009 | Derr | E05D 11/084 188/290 |
| 10,570,966 | B2 * | 2/2020 | Carlson | F16D 7/10 |
| 2010/0040474 | A1 | 2/2010 | Takahashi et al. | |
| 2011/0048197 | A1 * | 3/2011 | Winkler | B23Q 17/00 83/58 |

* cited by examiner

HOLDER ASSEMBLY FOR A CIRCULAR SAW TOOL

This application claims priority under 35 U.S.C. § 119 to patent application number IN 201841020446 filed on May 31, 2018 in India, the disclosure of which is incorporated herein by reference in its entirety.

FIELD OF THE INVENTION

The present invention relates to a holder assembly for a circular saw tool.

BACKGROUND OF THE INVENTION

According to a prior art US 2010/0040474, a fixing device for rotary blade is provided. A fixing device for fixing a rotary blade to a spindle in a bench circular saw, for example, has a structure in which it is difficult to achieve structural compactification in radial size. Therefore, there has been a problem of sacrificing an inclination angle and a cutting depth of the rotary blade. Provided is a fixing device free from such problems owing to employment of a structure which can be easily compactified in a radial direction. Cam portions are provided on respective surfaces opposite to each other of an intermediate flange and an outer flange so as to mesh with each other. The cam portions slide with each other with a rotational force imparted to the rotary blade so that the rotational force is converted into a displacement in a direction of an axis of the intermediate flange and is applied in a direction of clamping the rotary blade.

BRIEF DESCRIPTION OF THE ACCOMPANYING DRAWINGS

An embodiment of the disclosure is described with reference to the following accompanying drawings, FIG. 1 illustrates a side cross-section view of the holder assembly, according to an embodiment of the present invention.

DETAILED DESCRIPTION OF THE EMBODIMENTS

Figure 1:
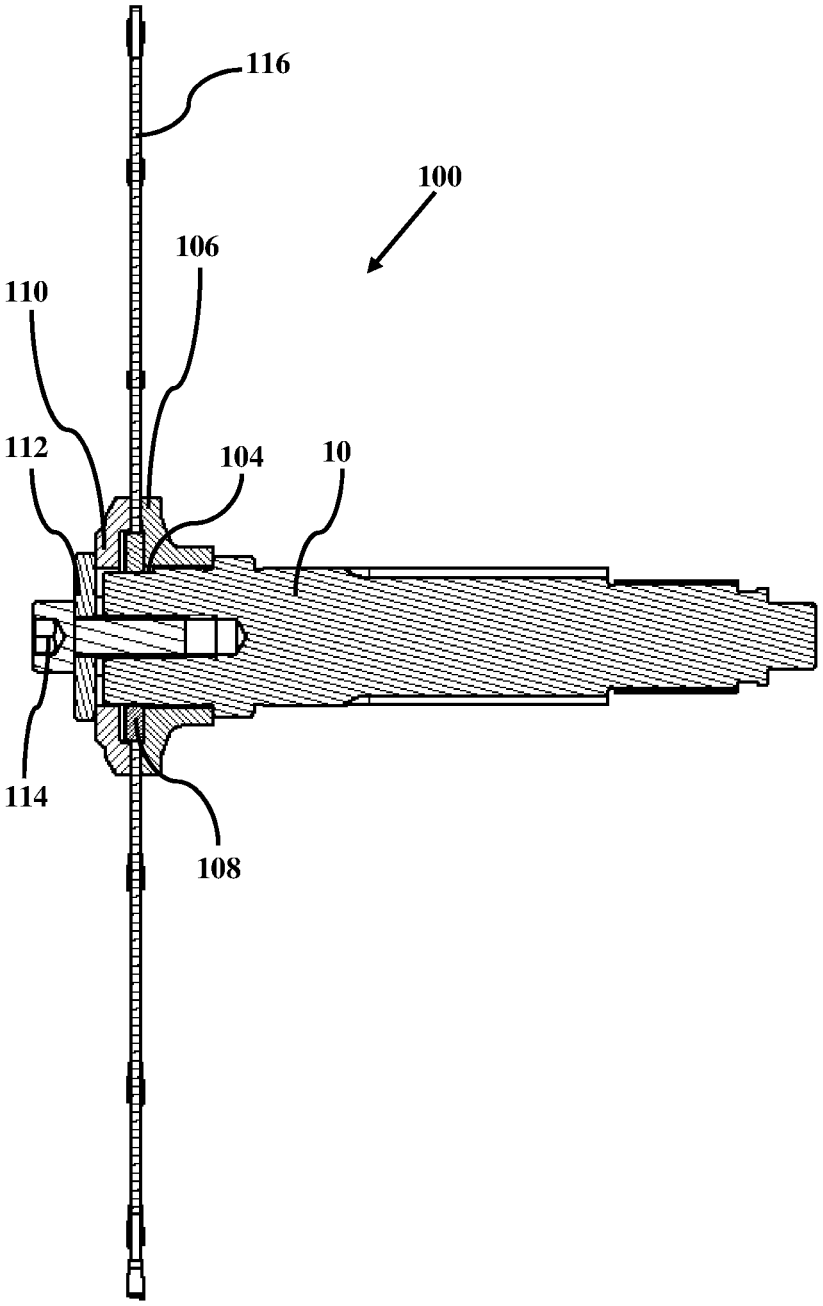

FIG. 1 illustrates a side cross-section view of the holder assembly, according to an embodiment of the present invention. The holder assembly 100 for the circular saw tool, comprises a blade 116 having a bore. The blade 116 is mountable to a free end of a rotatable shaft 102 or a spindle of the tool through the bore. The blade 116 is further adapted to be held in a pressing manner between an inner flange 106 and an outer flange 110 on the shaft 102. The holder assembly 100 is characterized by at least one depression 104 formed on a circumferential surface of the free end of the shaft 102, and at least one clutch member 108 (or dogs) paired and mounted about the at least one depression 104, and located between the bore of the blade 116 and the shaft 102. The depression 104 may also be referred to as profile.

The blade 116 is mounted over the at least one clutch member 108 and then held between the inner flange 106 and the outer flange 110 with the help of a washer 112 and a bolt 114.

The at least one clutch member 108 is adapted to brake rotation of the blade 116 under emergency conditions. One of the emergency condition may be presence of a body part of a human operator in proximity or in contact with the rotating blade 116. The braking or stopping of the rotation of the shaft 102, under emergency conditions is performed by separate devices or systems known in the art.

Figure 2:
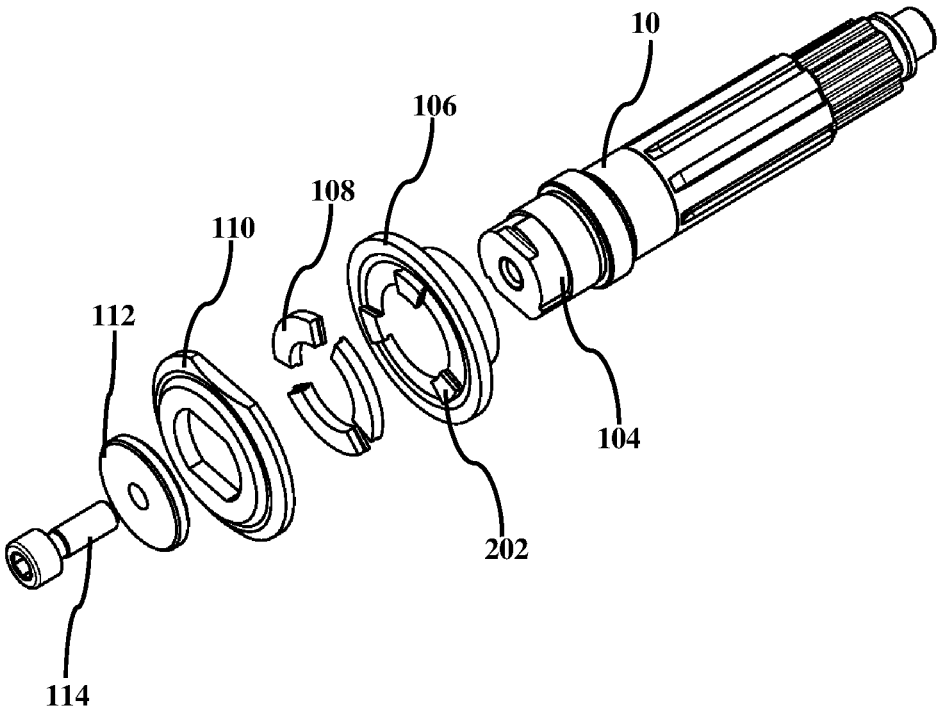
FIG. 2 illustrates an exploded view of a holder assembly for a circular saw tool, according to an embodiment of the present invention.

FIG. 2 illustrates an exploded view of a holder assembly for a circular saw tool, according to an embodiment of the present invention. The at least one clutch member 108 comprises two clutch members 108 paired and mounted about respective two depressions 104. At least two restraining elements 402 (shown in FIG. 4) are adapted to connect and hold the two clutch members 108 to the shaft 102. The restraining elements 402 are selected from a group comprising a leaf spring and a torsional spring. The restraining elements 402 are optional.

In accordance to another embodiment of the present invention, at least one clutch member 108 comprises three clutch members 108, paired and mounted about respective three depressions 104 as shown in FIG. 2. Further, at least three restraining elements 402 are adapted to connect and hold the three clutch members 108 to the shaft 102. The restraining elements 402 are selected from a group comprising a leaf spring and a torsional spring. The restraining elements 402 are optional.

Further, the inner flange 106 comprises at least one protrusion 202 acting as guide to position the at least one clutch member 108. The guide assist in placement of the at least one clutch member 108 in a fitting manner. In FIG. 2, three clutch members 108 are arranged between the three protrusions 202.

Figure 3:
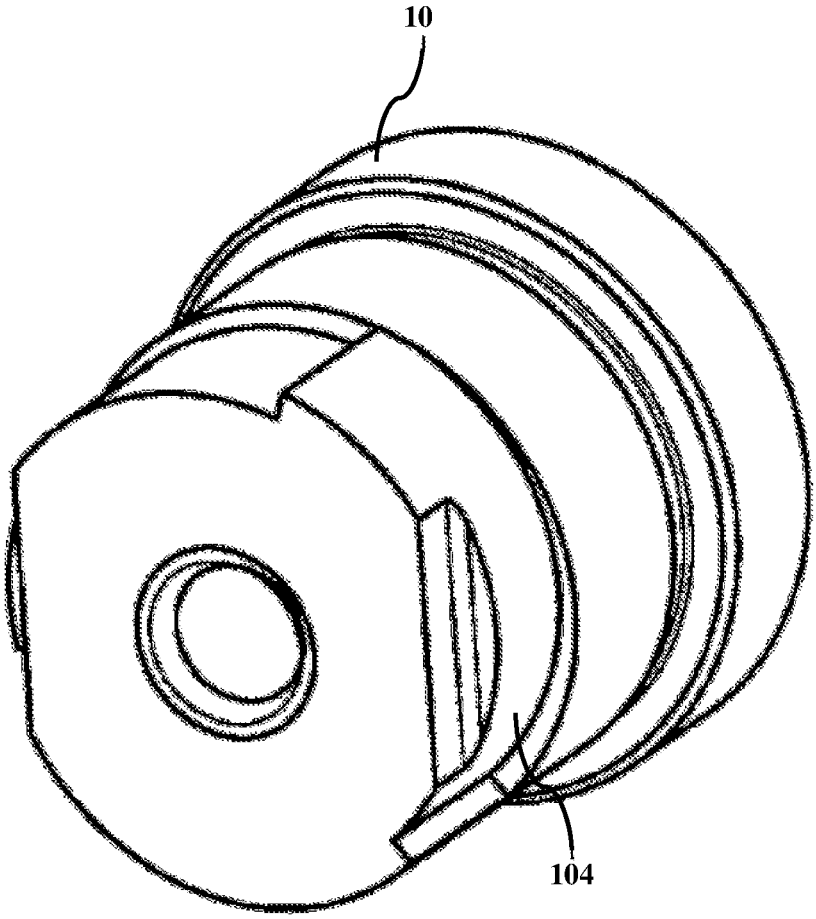
FIG. 3 illustrates a detailed view of a free end of the shaft, according to an embodiment of the present invention.

FIG. 3 illustrates a detailed view of a free end of the shaft, according to an embodiment of the present invention. The depression 104 for mounting the clutch member 108 is shown. The number of depressions 104 are equal to the number of clutch members 108 used. The depression 104 is in the form of curve with decreasing radius. Similarly, the at least one clutch member 108 is so designed that on pairing with the depression 104, the circumference of the at least one clutch member 108 forms a circle. The shaft 102 comprises an axial bore to accept the bolt 114 for firm attachment.

The circular saw tool is selected from a group comprising a table-top tool, a portable tool, a hand-held tool, a plunge tool and the like. In an embodiment, the holder assembly 100 is retrofit to existing circular saw tools.

Figure 4:
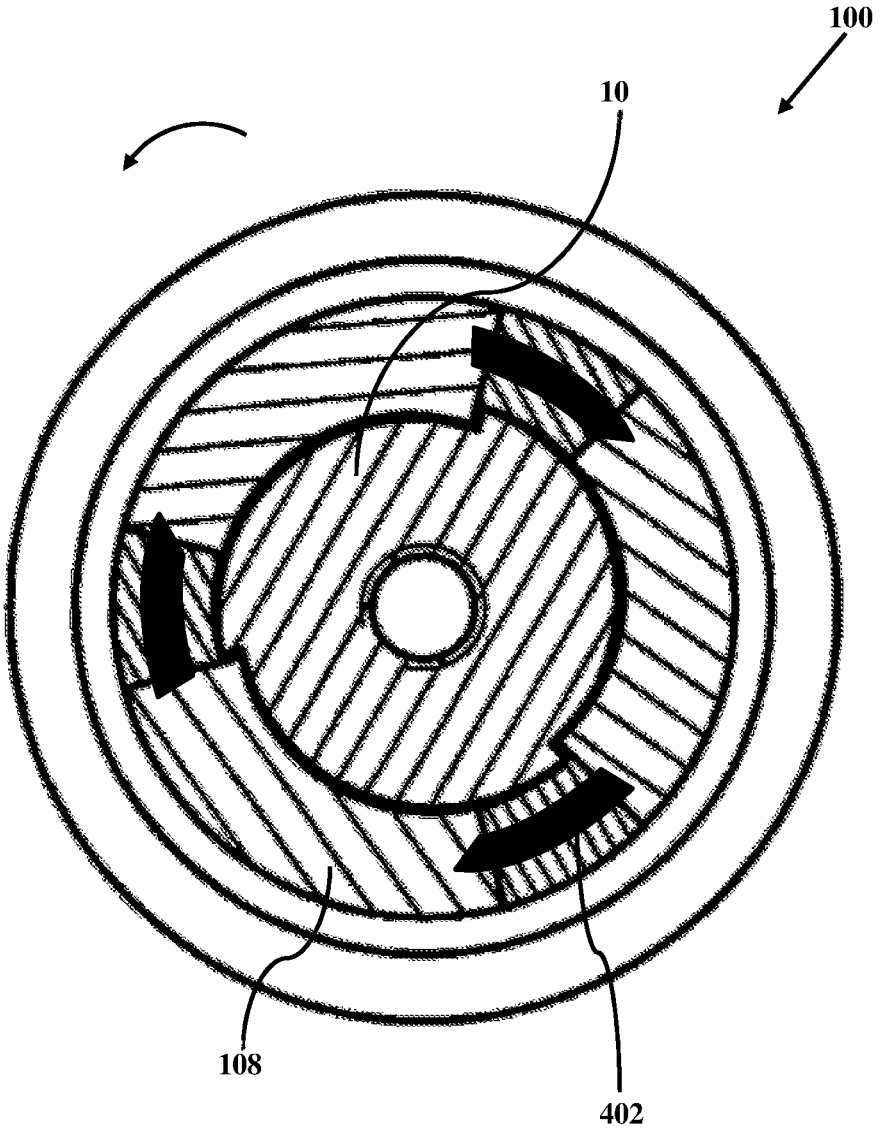
FIG. 4 illustrates a front cross-section view of the holder assembly, according to an embodiment of the present invention.

FIG. 4 illustrates a front cross-section view of the holder assembly, according to an embodiment of the present invention. The at least one clutch member 108 is in the form of a sector of a circle with varying radius, so as to match with the depression 104. The three clutch members 108 are held by the three restraining element 402.

A working of the holder assembly according to the present invention is disclosed. When the circular saw tool is in operation, the complete holder assembly 100 is rotated. When the shaft 102 stops suddenly with external mechanism called brake, the blade 116 tends to rotate due to inertia as it is held in place with inner flange 106 and the outer flange 110. The sub-assembly of the blade 116, the inner flange 106 along with the clutch members 108 tend to rotates due to the inertia of the blade 116. As the clutch members 108 rotate rotates on the shaft 102 due to motion input from the inner flange 106, the clutch members 108 tend to move radially out and grip the internal surface of the blade 116 by harder gripping force as blade 116 tends to rotate further. The gripping enhances as the clutch members 108 move on the depression 104 or profile of the shaft 102. Hence, the mechanism converts moment of inertia of the blade 116 into higher gripping of the blade 116 during deceleration. As the blade 116 stops, the gripping force tends to reduce as the clutch members 108 are held in place with the restraining element 402.

In accordance to an embodiment of the present invention, the holder assembly 100 provides improved gripping while safety or emergency braking with easy access to the blade 116 and also reduces efforts for changing the blade 116. Further, the mounting and demounting torque required for the blade 116 is within normal human limit. The holder assembly 100, enhances safety braking mechanism by hard gripping blade 116 at braking event. Also, the temperature of blade 116 does not rise as the rotation of the blade 116 is stopped instantly.

It should be understood that embodiments explained in the description above are only illustrative and do not limit the scope of this invention. Many such embodiments and other modifications and changes in the embodiment explained in the description are envisaged. The scope of the invention is only limited by the scope of the claims.

I claim:

1. A circular saw tool system, comprising:

a rotatable shaft including a first depression formed on a circumferential surface of a free end of said shaft, wherein the first depression has a first surface with a decreasing radius; and a first clutch member, the first clutch member mounted to the shaft and configured for use with a blade mountable to the free end of the rotatable shaft, wherein:

the first clutch member is mounted in the first depression in contact with the first surface, and configured to be located between a bore of said blade and said rotatable shaft, and the first clutch member and first depression are further configured such that when rotation of the rotatable shaft is braked, the first clutch member slides along the first surface and entire first clutch member moves in a direction radially away from the rotatable shaft to diminish rotation of the blade relative to the rotatable shaft.

2. The system as claimed in claim 1, further comprising: an inner and an outer flange configured to be mounted on the rotatable shaft and press the blade.

3. The system as claimed in claim 1, further comprising: a second clutch member mounted in a second depression.

4. The system as claimed in claim 3, further comprising: a first restraining element configured to connect and hold the first and second clutch members to said shaft.

5. The system as claimed in claim 4, wherein said first restraining element is selected from a group consisting of a leaf spring and a torsional spring.

6. The system as claimed in claim 4, further comprising: a third clutch member mounted in a third depression.

7. The system as claimed in claim 6, wherein said first restraining element is one of at least three restraining elements configured to connect and hold said first, second, and third clutch members to said rotatable shaft.

8. The system as claimed in claim 7, wherein said at least three restraining elements are selected from a group consisting of a leaf spring and a torsional spring.

9. The system as claimed in claim 1, wherein said circular saw tool system comprises at least one of a table-top tool system, a portable tool system, a hand-held tool system, and a plunge tool system.

10. The system as claimed in claim 1, wherein the first surface is in the form of a curve with the decreasing radius.

* * * * *